US005781994A

United States Patent [19]

Fouillet et al.

[11] Patent Number: 5,781,994

[45] Date of Patent: Jul. 21, 1998

[54] PROCESS FOR THE MICROMECHANICAL FABRICATION OF NOZZLES FOR LIQUID JETS

[75] Inventors: Yves Fouillet, Voreppe; Gilles Delapierre, Seyssins; Marie-Thérèse Delaye, Grenoble, all of France

[73] Assignee: Commissariate a l'Energie Atomique, France

[21] Appl. No.: 564,600

[22] Filed: Nov. 29, 1995

[30] Foreign Application Priority Data

Dec. 1, 1994 [FR] France ..... 94 14461

[51] Int. Cl.[6] ..... B41J 2/16

[52] U.S. Cl. ..... 29/890.1; 216/27

[58] Field of Search ..... 29/890.1, 25.35, 29/611; 216/27; 347/47; 156/125.1, 644.1, 633.1, 647.1; 346/140.1

[56] References Cited

U.S. PATENT DOCUMENTS

| | | | |
|---|---|---|---|
| 4,106,976 | 8/1978 | Chiou et al. | 156/644 |
| 4,601,777 | 7/1986 | Hawkins et al. | 156/626 |
| 4,612,554 | 9/1986 | Poleshuk | 346/140 R |
| 4,639,748 | 1/1987 | Drake et al. | 346/140 |
| 4,863,560 | 9/1989 | Hawkins | 156/644 |
| 4,878,992 | 11/1989 | Campanelli | 156/633 |
| 4,899,181 | 2/1990 | Hawkins et al. | 346/140 R |
| 4,961,821 | 10/1990 | Drake et al. | 156/647 |
| 5,160,403 | 11/1992 | Fisher et al. | 156/633 |
| 5,160,577 | 11/1992 | Deshpande | 156/644 |
| 5,308,442 | 5/1994 | Taus et al. | 156/644 |
| 5,387,314 | 2/1995 | Baugman et al. | 216/27 |
| 5,458,254 | 10/1995 | Miyagawa et al. | 216/27 |
| 5,548,894 | 8/1996 | Muto | 29/890.1 |
| 5,620,614 | 4/1997 | Drake et al. | 216/27 |

FOREIGN PATENT DOCUMENTS

A-0042932 1/1982 European Pat. Off. .

OTHER PUBLICATIONS

Patent Abstracts of Japan, vol. 009, No. 158, July 1985 & JP-A-600032673, Feb. 1985.

Patent Abstracts of Japan, vol. 015, No. 113, Mar. 1991 & JP-A-03007349, Jan. 1991.

Patent Abstracts of Japan, vol. 009, No. 139, Jun. 1985 & JP-A-60018352, Jan. 1985.

IEEE Transactions on Electron Devices, vol. ED-26, No. 12, Dec. 1979, pp. 1918-1920, K. Petersen, *Fabrication of an Integrated, Planar Silicon Ink-Jet Structure.*

IEEE Transactions on Electron Devices, vol. ED-25, No. 10, Oct. 1978, pp. 1178-1184, E. Bassous, *Fabrication of Novel Three-Dimensional Microstructures by the Anisotropic Etching of (100) and (110) Silicon.*

*Primary Examiner*—Larry I. Schwartz
*Assistant Examiner*—Marc W. Butler
*Attorney, Agent, or Firm*—Nilles & Nilles, S.C.

[57] ABSTRACT

A process for the micromechanical fabrication of nozzles for ink jets includes forming a groove on a surface of a first substrate, securing the first substrate to a second substrate to form an assembly in which the second substrate covers the groove to form a channel having walls, and then forming an internal protective coating within the channel by thermal oxidation of the walls of the channel. The first and second substrates are then cut along a plane extending perpendicular to the channel thereby to form a nozzle for dispensing a liquid jet. Scales, formed as a result of the cutting operations, are formed on the internal protective coating rather than directly on the walls of the channel. These scales then are removed from the nozzle by eliminating the internal protective coating.

15 Claims, 2 Drawing Sheets

PROCESS FOR THE MICROMECHANICAL FABRICATION OF NOZZLES FOR LIQUID JETS

BACKGROUND OF THE INVENTION

1. Technical Field

The present invention relates to a process for the micromechanical fabrication of nozzles for liquid jets. It is applicable to all systems using high precision liquid jets in the medical field, biological field or in printing. The invention more particularly applies to the production of nozzles for continuous jet or dropwise ink jet printer heads.

2. Discussion of the Related Art

In the fabrication of printer heads, the production of the ink jet nozzles is a decisive stage to the extent that it conditions the printing quality. Known microelectronic techniques are used for nozzle production.

For example, document (1), listed at the end of the Detailed Description, describes a precise fabrication process for circular nozzles by etching holes in a silicon wafer of crystal orientation <100>. Document (2), listed at the end of the Detailed Description, relates to a similar process for the fabrication of a plurality of nozzles on the same substrate. These nozzles permit the formation of liquid jets perpendicular to the plane of the substrate in which they are formed.

The methods used for machining fine grooves on the surface of a silicon wafer of crystal orientation <100> and <110> given in document (1) can also be advantageously used for the fabrication of nozzles, whose liquid ejection axis is parallel to the substrate wafer. This can e.g. be gathered from document (3), also listed at the end of the description.

The attached FIG. 1 permits a better understanding of the operation and fabrication of such nozzles.

One or more grooves 10 are etched on the surface 12 of a first substrate 14. A second substrate 16 is sealed on the first substrate 14 so as to cover the grooves 10 and in this way form channels. The assembly of the first and second substrates is then cut perpendicular to the grooves 10 in order to open the channels and form nozzles 18, which issue onto the cut face 20 represented by a broken line.

One or more tanks or reservoirs 22 are also provided, in connection with one or more nozzles 18, in order to supply them with a liquid, such as ink. A printing head also has active elements such as electrodes or piezoelectric elements for the control of the printing, which are not shown in the drawing for simplification reasons.

The etching of the grooves in the substrate 14 and the sealing of the second substrate on the first are presently well controlled land mastered operations and cause no particular problem. The operation of cutting or sawing for opening the channels is particularly delicate from the fabrication standpoint.

In a known manner, substrates are cut by using blades which machine the substrates, in the present case made from silicon, by tearing away material. The cutting of the substrates give rise to two major problems illustrated in FIG. 2, which is a larger scale view of face 20, following cutting.

The first problem is due to the presence of dust 22 particles which results from the cutting operation and which pollute the interior of the nozzles 18 and can in certain cases form a plug obstructing the nozzles 18. It is therefore necessary, after cutting, to carry out a careful cleaning of the nozzles.

A second problem is due to the formation of chips or scales 24 on the intersection edges 26 of the cutting plane of the face 20 and the nozzles 18, which have prejudicial effects on the jet quality. Thus, the scales lead to dispersions in the direction of the jets, as well as to instabilities able to modify the dynamic behaviour of the jets.

The size of the scales is dependent on the cutting conditions. Document (4), listed at the end of the description, describes a process for minimizing scale size. According to document (4), scales larger than 2 μm are not acceptable for heat printers. To avoid such scales, the exit face at the nozzles is obtained by a first cutting operation using a resin-based blade with a thickness of 100 to 250 μm (4 to 10 mils) and having a rotation speed of 32000 to 45000 r.p.m. The complete cutting of the two substrates is brought about with a standard blade, which is finer than the first blade. This document also describes all of the cutting parameters. However, scales with a size of approximately 1 micron are still left on the edges of the nozzles. For certain applications, the improvement proposed by this document is inadequate, which is e.g. the case with continuous ink jet printers.

Operations involving the polishing of the cutting face can be envisaged.

Other processes for the fabrication of nozzles have been envisaged in order to avoid the problem of scales. For example, document (5), listed at the end of the Detailed Description, has the exit plane of the nozzles corresponding to a crystal plane <111> of the silicon machined by anisotropic chemical etching of a <110> oriented substrate. A second, precut substrate is then aligned with the exit plane of the nozzles. This solution has the advantage of not producing the exit plane of the nozzles by sawing. Due to silicon etching laws, it is, however, impossible in this case to have jets perpendicular to the exit plane of the nozzles if the latter are produced by anisotropic etching. In the aforementioned article, the nozzles are produced by isotropic etching, whose quality is lower than that of anisotropic etching.

One object of the present invention is therefore to propose a process for the micromechanical fabrication of nozzles with a very great precision not suffering from the aforementioned disadvantages.

Another object of the invention is to propose a process permitting the fabrication of nozzles, whose edges with the liquid ejection face have no scales.

SUMMARY OF THE INVENTION

In order to achieve the above objects, the invention proposes a process having the following stages:

a) formation of at least one groove on the surface of a first substrate, b) assembly of the first substrate with a second substrate covering the groove in order to form at least one channel, c) formation of an internal protective coating within the channel by thermal oxidation of the channel walls, d) cutting the first and second substrates perpendicular to the channel to form at least one nozzle for a liquid jet, e) elimination of the internal protective coating.

As a result of the invention, the imperfections and scales occurring during the cutting operation take place in the internal protective coating and are eliminated at the same time as the coating leaving a clean nozzle.

Thus, the process of the invention makes it possible to manufacture nozzles with a perfect jet quality no matter what the cutting method. The cutting method and/or thickness of the coating are chosen in such a way that the scale size is smaller than the coating thickness. Therefore the coating protects the nozzle.

According to a special aspect of the invention, the first substrate is a wafer of crystal orientation <100> and, during stage a) of the process, grooves are formed with anisotropic etching by stopping on the <111> planes of the crystal lattice of the first substrate.

The first and second substrates can be made from identical or different materials. However, according to a preferred embodiment of the invention, the first and second substrates are made from silicon.

When the substrates are made from silicon, the silicon oxide coating can be eliminated in a hydrofluoric acid bath.

According to another aspect, it is also possible to make an orifice and/or a supply reservoir for each nozzle, advantageously in at least one of the first and second substrates.

BRIEF DESCRIPTION OF THE DRAWINGS

Other features and advantages of the invention can be gathered from the following non-limitative, illustrative description and with reference to the attached drawings, wherein show.

DETAILED DESCRIPTION OF EMBODIMENTS OF THE PROCESS ACCORDING TO THE INVENTION

Figure 1:
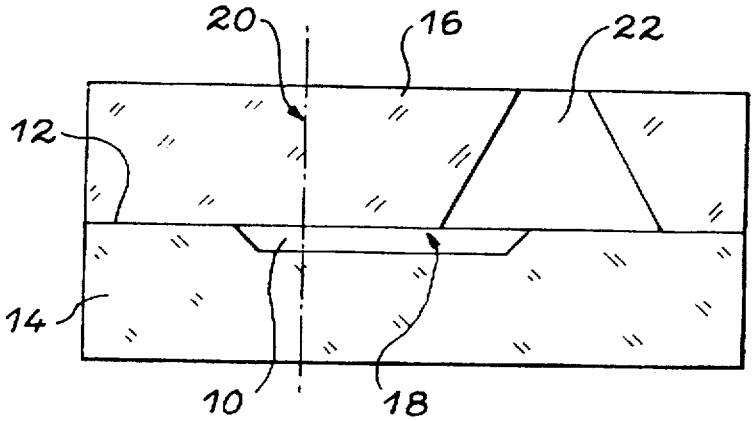
FIG. 1, already described, a diagrammatic, longitudinal section of a detail of a printing head during the fabrication of nozzles for liquid jets,labeled "Prior Art".
Figure 2:
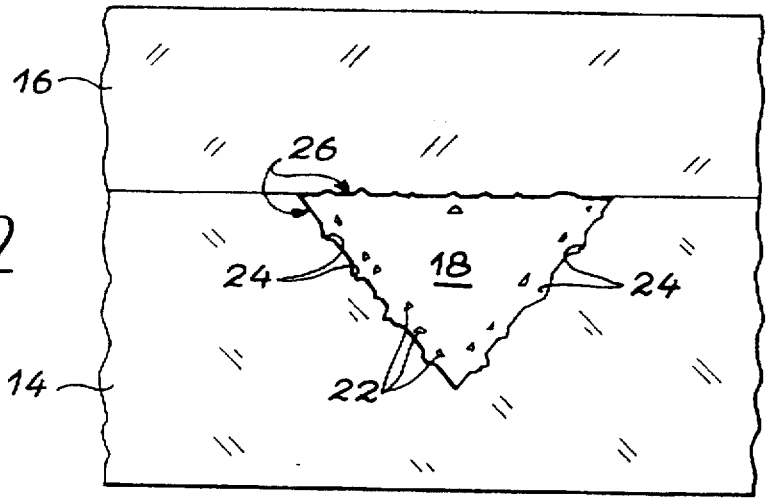
FIG. 2, already described, a larger scale, partial, diagrammatic view of a face where the nozzle produced in accordance with the prior art issues, labeled "Prior Art ".
Figure 3:
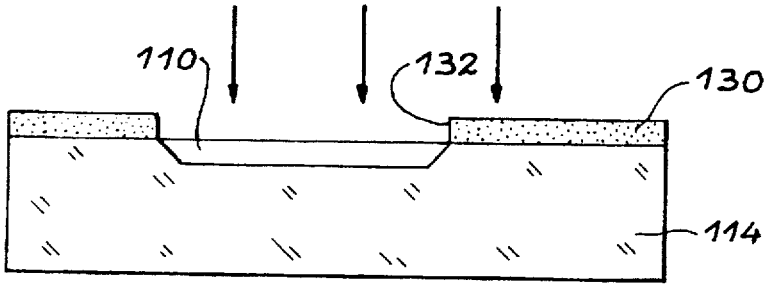
FIG. 3 A longitudinal section of a first substrate illustrating one stage of the fabrication of a nozzle according to the invention.
Figure 4:
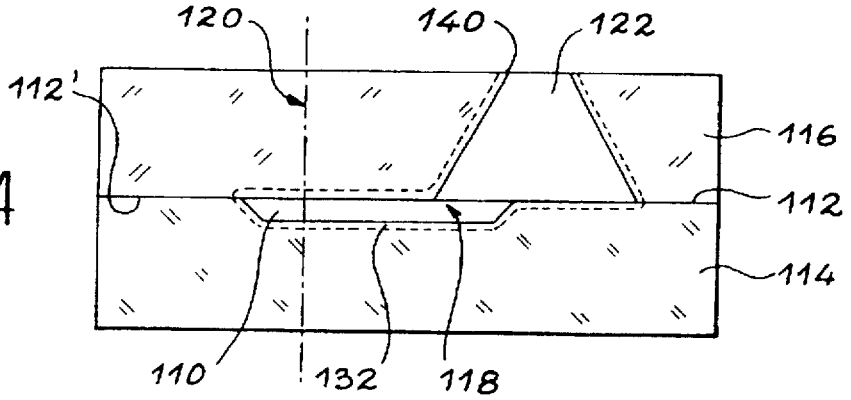
FIG. 4 A longitudinal section of a detail of a printing head, during the fabrication of a nozzle according to the process of the invention and having an internal protective coating for the nozzle.
Figure 5:
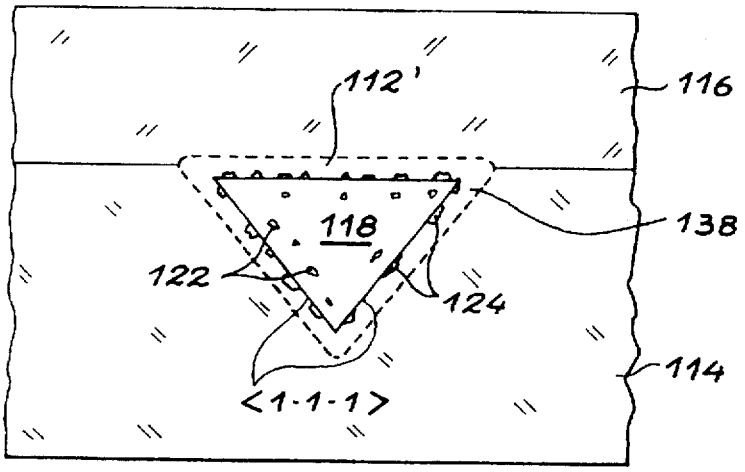
FIG. 5 A larger scale, partial, diagrammatic view of a face of a nozzle which is fabricated according to the process of the invention and which is provided with an internal protective coating.

During the description of FIGS. 3 to 5, references to which 100 have been added are used for the corresponding elements, which are identical or similar to those of FIGS. 1 or 2. For reasons of clarity, the different parts of the drawings are not represented to the same scale. Finally, for simplification reasons, the drawings only show a single groove and/or a single nozzle. However, the process permits the simultaneous fabrication of a plurality of nozzles. Thus, the description will refer to a plurality of nozzles, although only one is shown on each occasion.

As shown in FIG. 3, following the cleaning of its surface, on a first silicon substrate 114 of orientation <100> is formed a silicon nitride coating 130 in which are made longitudinal openings 132 oriented in direction <110> and defining a location for grooves.

This structure subjected to the action of an agent such as a potassium hydroxide bath, symbolized by arrows, in order to carry out the anisotropic etching of the grooves 110. The etching time is sufficient to obtain grooves by stopping on two crystal planes <111> of the crystal lattice of silicon. This makes it possible to utilize the perfect geometrical quality of crystal orientations.

The process takes advantage of the etching speed difference on different crystal planes of the substrate, and reference can also be made in this connection to document 1.

Using an identical process, etching takes place in a second substrate 116, visible in FIG. 4, of a reservoir 122 for supplying the nozzle or nozzles e.g. with ink. According to a variant, said reservoir can also be produced directly in the first substrate.

Following etching of the substrates, the silicon nitride coating 130 is eliminated and the surfaces 112, 112' to be sealed of the substrates are subject to a bath making them hydrophilic.

After rinsing and drying, the two substrates are directly sealed. They are positioned and then pressed against one another to obtain the structure shown in FIG. 4, where the second substrate 116 covers the grooves 110 in order to form channels.

A first heat treatment is carried out to create chemical bonds at the interface 112, 112' between the two substrates 114, 116 and for thus ensuring a good mechanical behaviour of the assembly.

This is followed by the formation of a protective coating in the channel. In the example described it is a silicon oxide coating 138 obtained by a heat treatment under an oxygen flow, but could also be a coating of some other nature, such as e.g. a thin nickel coating, e.g. obtained by chemical deposition. Such an oxidation treatment permits a precise control of the thickness of the coating 138. In order to permit this oxidation, an access orifice to the channels must be provided. This orifice could e.g., comprise an orifice 140 of the reservoir 122. The thickness of the coating 138 must be adequate to prevent scales being formed in the silicon. In the example described, a thickness of about 1 to 4 μm is appropriate.

The process continues with the cutting of the assembled substrates, perpendicular to the channels, to form nozzles 118, which issue on a face 120.

This surface and the cutting line are represented in broken line form in FIG. 4. Cutting e.g. takes place by a diamonded resin blade. This operation also permits the definition of the length of the nozzles which, according to the envisaged application, results from a compromise between the hydraulic head loss problems of liquid jets and the stability and precision problems in the direction of the jets.

FIG. 5 shows the face 120 of the substrates after cutting. It is possible to see a nozzle 118 and the oxide coating 138 forming the internal protective coating. The coating extends over the face 112' of the substrate 116 defining the nozzle and on the faces corresponding to the crystal planes <111> of the substrate 114. As can be seen in FIG. 5, scales 124 form on the coating 138, and silicon oxide dust 122 is deposited in the nozzle 118.

Figure 6:
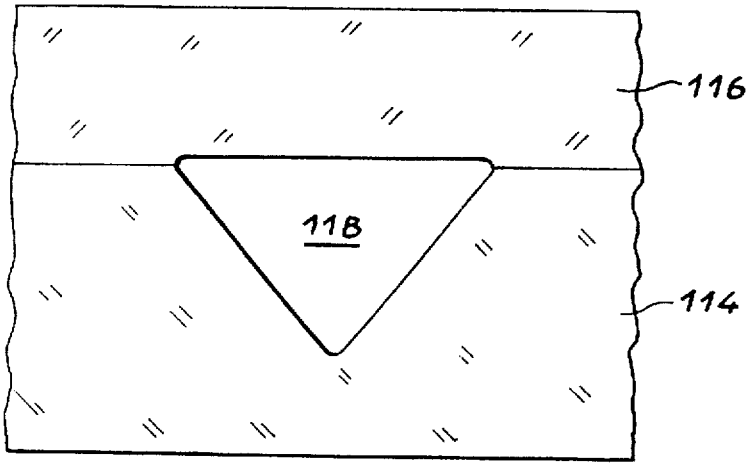
FIG. 6 A partial, diagrammatic view of a face of a nozzle which is fabricated according to the process of the invention following the elimination of the internal protective coating.

The cut structure is then immersed in a hydrofluoric acid bath, which not only suppresses the oxide coating 138, but also all the dust 122. As shown in FIG. 6, this gives a nozzle 118, whose orifice on the face 120 is perfectly clean.

Compared with FIG. 2, the angles of the nozzle 118 are more rounded. Moreover, the initial depth of the grooves and the thickness of the coating are determined so as to obtain, following the elimination of said coating, a nozzle whereof the hydraulic diameter corresponds to the envisaged application. This hydraulic diameter is e.g. a few dozen micrometers.

Finally, as a result of the process according to the invention, it is possible to obtain nozzles compatible with the geometrical quality requirements of nozzles and therefore the jet precision for printers and in particular continuous ink jet printers.

DOCUMENTS CITED (1) "Fabrication of Novel Three-Dimensional Microstructures by the Anisotropic Etching of <100> and <11O> Silicon", Ernest Bassous IEEE TRANSACTIONS ON ELECTRON DEVICE, vol. 25, No. 10, pp 1178–1184

(2) U.S. Pat. No. 4,106,976

(3) U.S. Pat. No. 4,639,748

(4) U.S. Pat. No. 4,878,992

(5) "Fabrication of an integrated Planar Silicon, Ink-jet Structure", Kurt E. Petersen, IEEE Transactions of Electron Devices, vol. Ed-26, No. 12, pp 1918–1920

We claim:

1. Process for the micromechanical fabrication of nozzles for ink jets comprising the following steps:

a) forming at least one groove on a surface of a first substrate, b) covering the groove with a second substrate in order to form at least one channel, c) forming an internal protective coating within the channel by thermal oxidation of walls of the channel, d) cutting the first and second substrates perpendicular to the channel to form at least one nozzle for a liquid jet, e) eliminating the internal protective coating.

2. Process according to claim 1, further comprising forming at least one of an orifice and a reservoir in at least one of the first and second substrates.

3. Process according to claim 1, wherein the first substrate is a wafer of orientation <100>, and wherein grooves are formed during the step a) by anisotropic etching so that the grooves stop on planes <111> of a crystal lattice of the first substrate.

4. Process according to claim 1, wherein the first and second substrates are made from silicon.

5. Process according to claim 1, wherein the internal protective coating is of silicon oxide, and wherein said coating is eliminated in a hydrofluoric acid bath.

6. Process according to claim 1, wherein, during the step a), a silicon nitride coating forms on the first substrate, and wherein longitudinal openings are formed in said silicon nitride coating oriented in direction <110> defining a location for the grooves and further comprising subjecting the first substrate to a potassium hydroxide bath in order to bring about an anisotropic etching and then, after etching, eliminating the silicon nitride coating.

7. A process for the micromechanical fabrication of nozzles for ink jets, said process comprising:

a) forming a groove on a surface of a first substrate;

b) securing said first substrate to a second substrate to form an assembly in which said second substrate covers said groove to form a channel having walls; then c) forming an internal protective coating within said channel by thermal oxidation of the walls of said channel; then d) cutting said assembly along a plane extending perpendicular to said channel thereby to form a nozzle for dispensing a liquid jet; and then e) eliminating said internal protective coating.

8. A process as defined in claim 7, wherein scales form on said internal protective coating as a result of said cutting step, and wherein said scales are removed upon the elimination of said internal protective coating.

9. A process as defined in claim 7, wherein the step of forming said internal protective coating comprises subjecting said walls of said channel to heat treatment under an oxygen flow to form a silicon oxide coating.

10. A process as defined in claim 7, wherein said internal protective coating is between about 1 μm thick and about 4 μm thick.

11. A process as defined in claim 7, wherein the step of eliminating said internal protective coating comprises immersing said assembly in a hydrofluoric acid bath.

12. A process for the micromechanical fabrication of nozzles for ink jets, said process comprising:

a) forming a groove on a surface of a first substrate by an anisotropic etching process; then b) securing said first substrate to a second substrate to form an assembly in which said second substrate covers said groove to form a channel having walls; then c) forming an internal protective coating within said channel by thermal oxidation of the walls of said channel; then d) cutting said assembly along a plane extending perpendicular to said channel thereby to form a nozzle for dispensing a liquid jet, wherein scales form on said internal protective coating as a result of said cutting step; and then e) eliminating said internal protective coating to remove said scales.

13. A process as defined in claim 12, wherein the step of forming said internal protective coating comprises subjecting said walls of said channel to heat treatment under an oxygen flow to form a silicon oxide coating.

14. A process as defined in claim 12, wherein said internal protective coating is between about 1 μm thick and about 4 μm thick.

15. A process as defined in claim 12, wherein the step of eliminating said internal protective coating comprises immersing said assembly in a hydrofluoric acid bath.

* * * * *